United States Patent [19]

Wright

[11] 4,019,165

[45] Apr. 19, 1977

[54] MINIATURE RELAY DEVICE

[75] Inventor: William W. Wright, Wheaton, Ill.

[73] Assignee: Guardian Electric Manufacturing Company, Chicago, Ill.

[22] Filed: Sept. 8, 1975

[21] Appl. No.: 611,180

[52] U.S. Cl. ..... 335/126; 335/131

[51] Int. Cl.[2] ..... H01H 45/04

[58] Field of Search ..... 335/135, 129, 126, 131, 335/202, 203, 133

[56] References Cited

UNITED STATES PATENTS 3,828,286 8/1974 Bain ..... 335/126

*Primary Examiner*—Harold Broome

*Attorney, Agent, or Firm*—Allegretti, Newitt, Witcoff & McAndrews

[57] ABSTRACT

An improved multiple-pole, miniature relay includes a housing with a coil, a core, an attached field piece, armature and armature return spring positioned therein. The armature engages a lifter which is restrained from movement within the housing except in a direction parallel to the axis of the core. The lifter is connected with a plurality of pivotal contact blades. One or both ends of the blades have contacts thereon adapted to engage with contact pins depending upon the mode of pivotal movement. Electric contact is maintained through the blades by mounting the blades upon additional contact pins.

11 Claims, 9 Drawing Figures

MINIATURE RELAY DEVICE

BACKGROUND OF THE INVENTION

In a principal aspect, the present invention relates to a relay construction and, more particularly, to a unique construction enabling manufacture of a miniature relay utilizing a minimum number of parts.

With the advent of transistorized control circuits and the consequent decrease in power requirements for control circuits, there has been a concurrent demand for miniaturization of mechanical relays. Such relays must not only be physically small, but they also must be capable of handling relatively large currents by providing accurate and quick relay action. Additionally, such relays should be inexpensive, easily repaired and capable of manufacture in accordance with mass production methods. To provide such a miniature relay construction is merely one objective of the present invention.

SUMMARY OF THE INVENTION

Briefly, the present invention comprises an improved relay construction of the type having a plurality of poles. The relay is retained in its entirety within a housing. A plurality of contact pins project through the base of the housing to the interior thereof. Moving contact blades are pivotally mounted on some of the pins. A coil assembly is maintained within the housing and operates an armature which in turn actuates a lifter. The lifter is mechanically connected with the pivotally mounted moving contact blades to effect a relay action. Various physical features of the relay construction enable miniaturization thereof.

It is thus an object of the present invention to provide an improved relay construction.

It is a further object of the present invention to provide an improved relay construction wherein relay action is effected by movement of pivotally mounted contact blades within the housing, said blades being responsive to movement of an armature actuated by a coil.

One further object of the present invention is to provide a relay construction of simple construction that does not require soldering operations.

One further object of the present invention is to provide a simplified relay construction which is easily repairable, that is, a relay wherein the contacts and movable blades are replaceable.

Still another object of the present invention is to provide a relay construction which lends itself to production or assembly line manufacturing techniques.

These and other objects, advantages and features of the present invention will be set forth in the detailed description which follows.

BRIEF DESCRIPTION OF THE DRAWING

In the detailed description which follows, reference will be made to the drawing comprised of the following Figures.

DESCRIPTION OF THE PREFERRED EMBODIMENT

Figure 1:
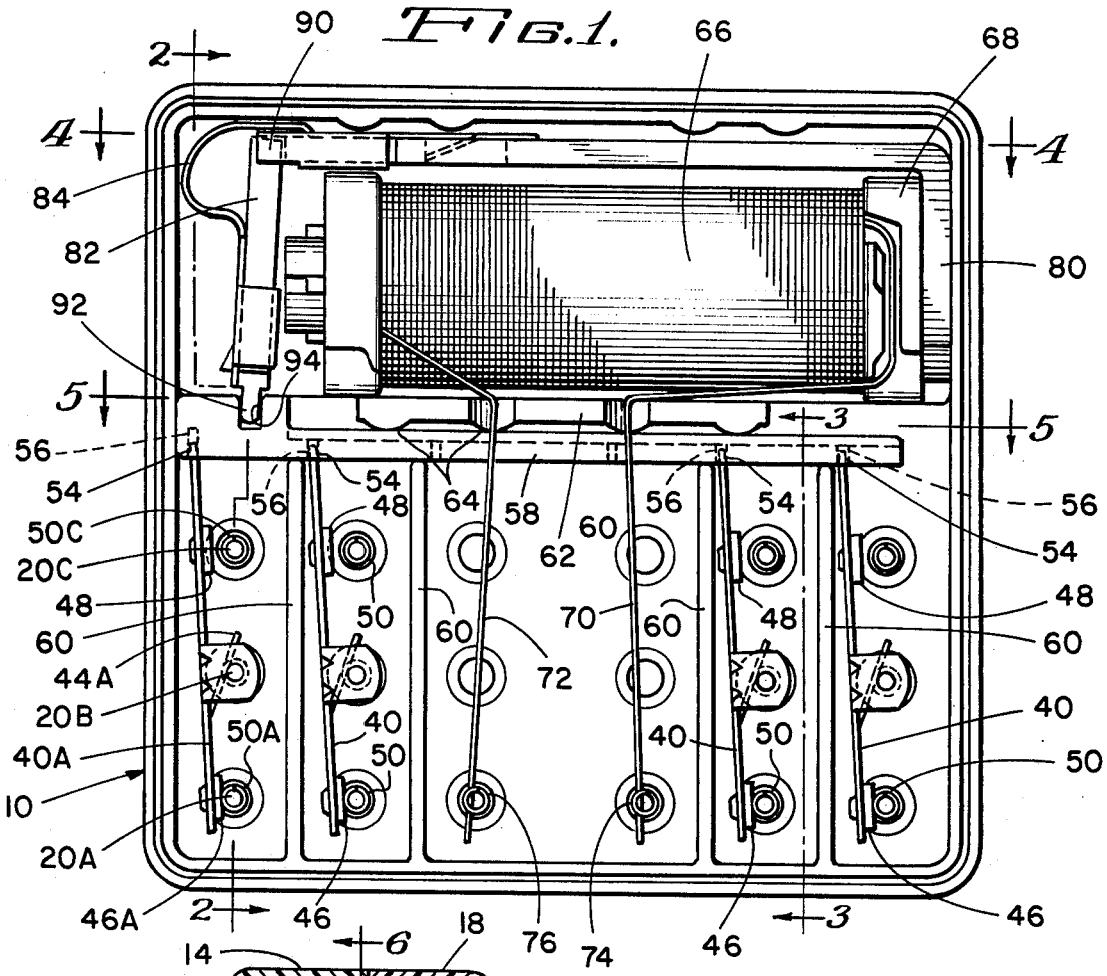
FIG. 1 is a plan view of the improved relay of the present invention wherein the cover of the relay has been removed.

The following description relates to a four-pole, double-throw relay construction. It is to be understood, however, that the description shall not be construed as a limitation of the invention since, as explained below, the relay may be constructed and used to provide various relay actions.

Referring to the Figures, the relay of the present invention is a miniature relay having dimensions of, for example, one and one-quarter inch wide by one and one-quarter inch long by three-eighths inch thick. The relay includes a housing 10 having a base 12 and a peripheral side wall 14. A cover 16 includes a circumferential or peripheral flange 18 which cooperates with the side wall 14 to effectively lock the cover 16 with the base 12. The locking action of flange 18 and wall 14 is a common snap action locking arrangement inasmuch as the cover 16 and base 12 are preferably fabricated from a flexible plastic material. The cover 16 and base 12 are made from an insulating material, that is, a non-conducting material.

Projecting through the base 12 and molded therein are a plurality of conducting contact pins 20. The pins 20 include oppositely extending ends 22 and 24 and a connecting intermediate portion 26. Pins 20 are made from an electrically conductive material.

Figure 8:
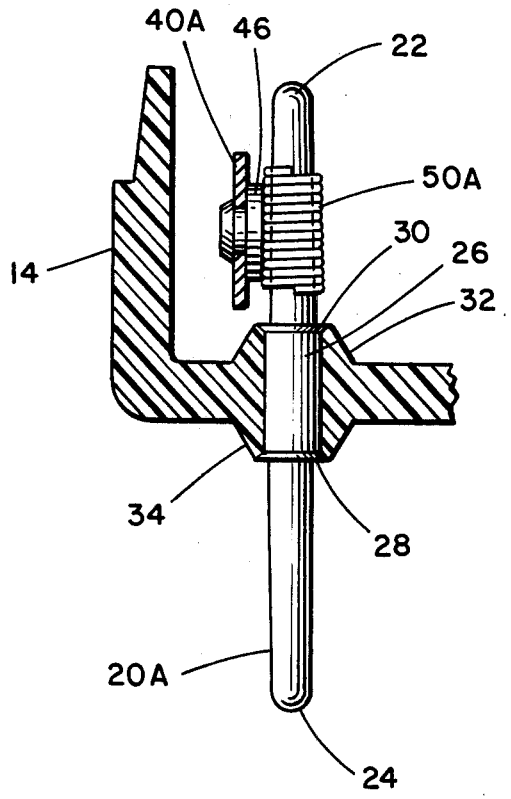
FIG. 8 is a cross-sectional view of one of the contact pins taken along the line 8—8 in FIG. 7.
Figure 9:
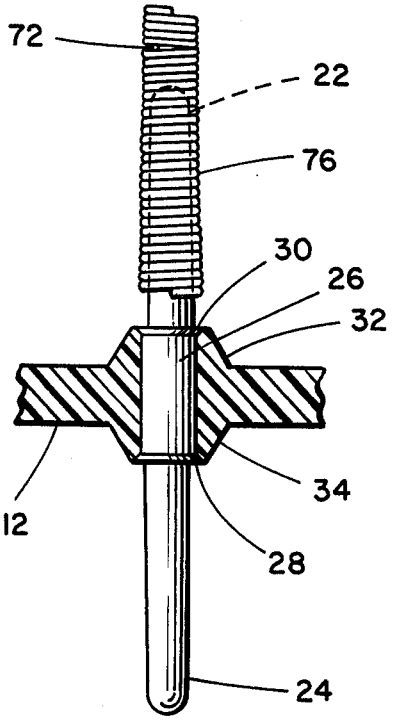
FIG. 9 is a cross-sectional view of another of the contact pins taken along the line 9—9 in FIG. 7.

The intermediate portion 26 has an expanded diameter relative to the ends 22 and 24 and also includes formed flanges 28 and 30 as illustrated in further detail in FIGS. 8 and 9. Flanges 28 and 30 serve to lock the contact pins 20 in a fixed molded position in the base 12.

The intermediate portions 26 are generally molded in a thickened portion of base 12. Base 12 thus includes frusto-conical projections 32 and 34 on the inside surface and outside surface, respectively. Outside projections 34 provides a means for spacing the relay from a component board so that air can circulate about the relay to effect proper cooling. Thus, the projection 34 serves to space the base 12 from a contact board (not shown) when the end 24 of the contact pin 20 is inserted in an appropriate opening in a board. Moreover, the thickened projections 32 and 34 provide additional rigidity and structural integrity for mounting of the contact pins 20 in the base 12.

Figure 2:
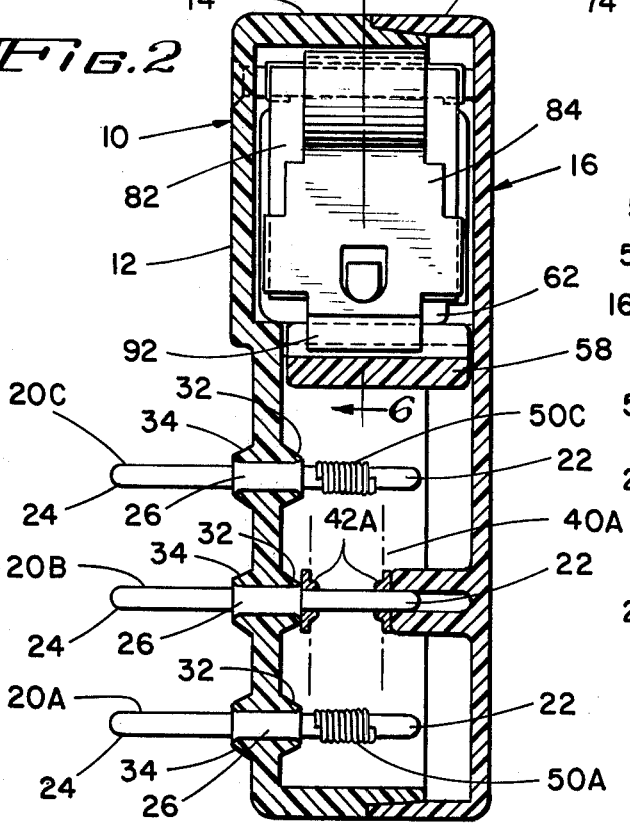
FIG. 2 is a cross-sectional view of the relay construction taken along the line 2—2 in FIG. 1.

The pins 20 are arranged in any desired array in order to cooperate with moving blades 40 mounted on one of the inside ends 22 of certain pins 20. In the embodiment disclosed, three pins 20A, 20B, 20C are arranged in a row. A single blade 40A includes folded over tabs 42A in FIG. 2 which are formed to cooperate with the end 22 of pin 20B so that the moving blade 40A may freely pivot on the end 22. A contact tab 44A is stamped out of the blade 40A and maintains sliding electric contact with the end 22 of pin 20A at all pivotal positions of the blade 40A.

Figure 3:
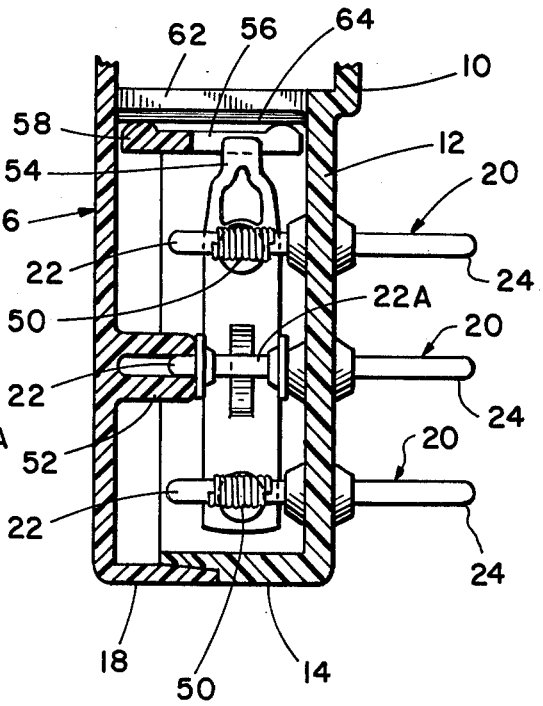
FIG. 3 is a cross-sectional view of the relay taken along the line 3—3 in FIG. 1.
Figure 4:
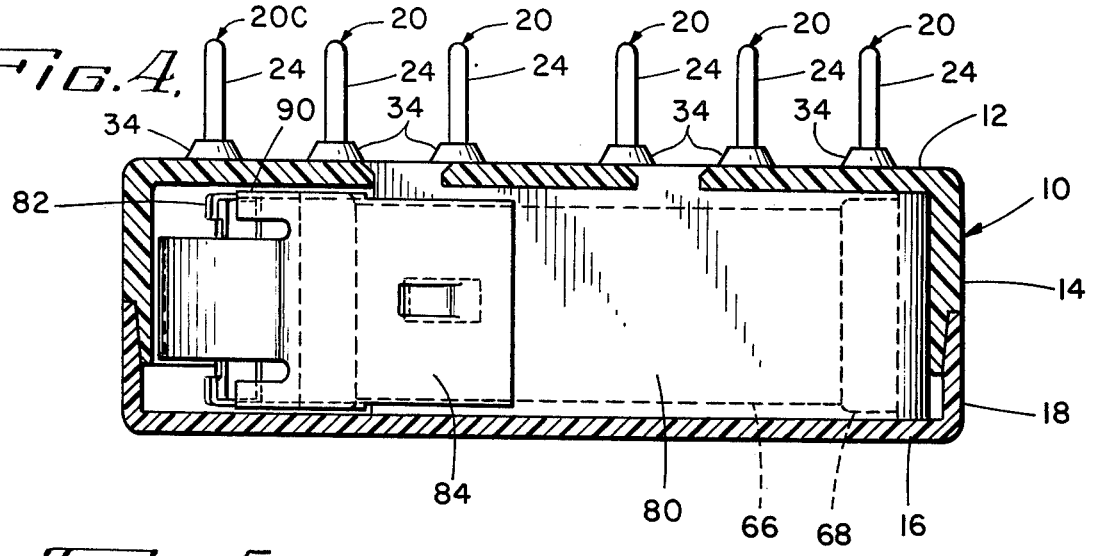
FIG. 4 is a cross-sectional view of the relay taken along the line 4—4 in FIG. 1.
Figure 5:
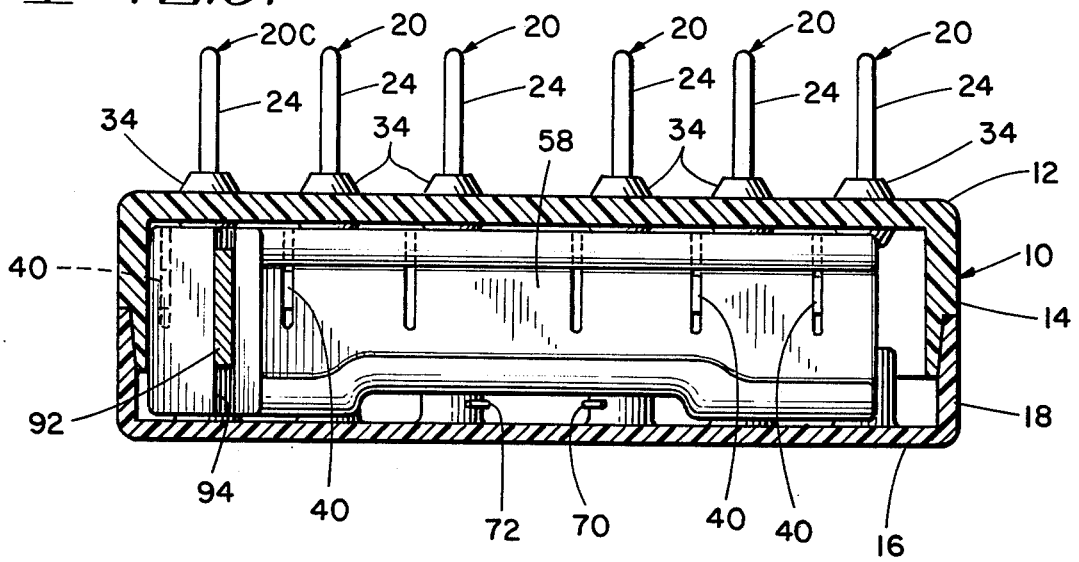
FIG. 5 is a cross-sectional view of the total relay taken along the line 5—5 in FIG. 1.
Figure 6:
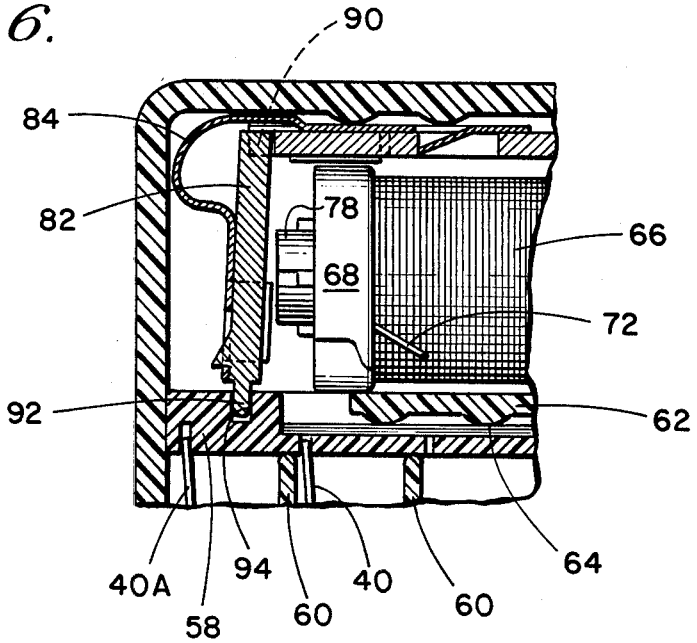
FIG. 6 is a cross-sectional view illustrating the armature and field piece construction taken along the line 6—6 in FIG. 2.
Figure 7:
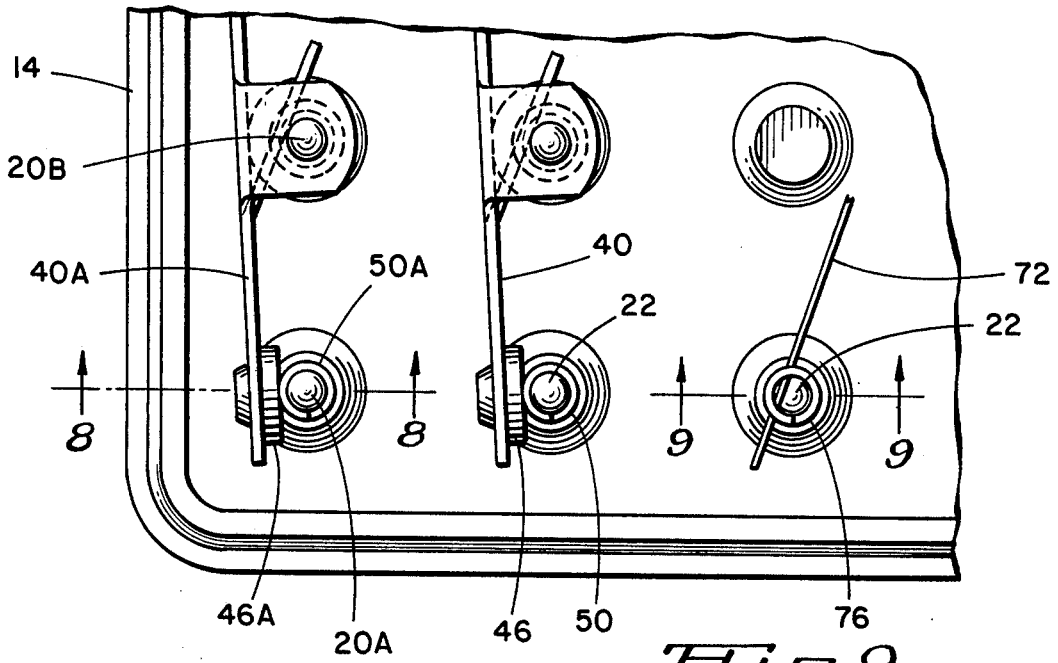
FIG. 7 is an enlarged plan view of the moving blade portion of the improved relay.

It will be noted by reference to FIG. 3 that the contact blades 40 are maintained in fixed position against the projection 32 of the base 12 by the cooperative action of a depending annular projection 52 defined in the cover 16. Annular projection 52 cooperates with the end 22B of pin 20B and maintains the pivot tabs 42A in proper position. The spacing of the projection 52 and top surface of projection 32 is substantially equal to the spacing between pivot tabs 42A of blade 40A. This provides for proper alignment of blades 40 within the relay and, upon removal of the cover 16, permits removal and replacement of blades 40 in an easy and simple manner. The blades 40 are easily assembled on associated pins 20 since no soldering or other additional manufacturing step is required.

The blade 40A includes first and second fixed contacts 46 and 48, respectively, attached thereto. Similar contacts 46, 48 are associated with the other pins 20. The end 22 of pin 20A includes a spiral spring 50A of precious metal conductive material. Likewise, the other pin ends 22 cooperative with a fixed contact such as contacts 46, 48 include spring 50. The fixed contact 46A, when in the pivot position illustrated in FIG. 1, provides an electrical path from the pivot pin 20B through contact tab 44, blade 40, fixed contact 46, spring 50 and pin 20A.

Pivoting the blade 40A in the clockwise direction as illustrated in FIG. 1 will cause the contact 46A to break the circuit with pin 20A and make a circuit with pin 20C. Pin 20C similarly has contact spring 50C. The contact construction is described in greater detail in copending application Ser. No. 622,888, filed Oct. 16, 1975 and now abandoned, Improved Contact Construction for Relays, William W. Wright, which is incorporated herewith by reference.

Each of the contact blades 40 are of similar construction to that just described. Each of the contact blades 40 also include a cantilever projection or tab 54 cooperatively engaged with a slot 56 defined in a movable lifter 58. The lifter 58 is preferably fabricated from a non-conductive, plastic material. It is mounted for free movement within the housing 10 back and forth in the direction as illustrated in FIG. 1. That is, lifter 58 is retained and restrained from movement by walls 60 which separate adjacent blades 40. Lifter 58 is also restrained by permanent coil retaining wall 62. Wall 62 includes protuberances 64 which engage the side surface of lifter 58 thereby reducing the total friction between lifter 58 and coil wall 62. Translational movement of lifter 58 between walls 60 and 62 imparts a rotational movement to the blades 40.

Retained within the housing 10 on the side of the coil wall 62 opposite blades 40 is a coil assembly. The coil assembly includes a coil 66 wound on a bobbin 68. The bobbin 68 is preferably of a plastic material and includes grooves and channels for lead wires 70 and 72 from the coil 66. Leads 70, 72 connect with contact spring 74 and 76 as illustrated in FIGS. 1 and 9 and described in the above-noted co-pending application.

A core 78 is retained within the center of the coil 66 and bobbin 68. Core 78 defines the longitudinal axis of the coil 66 as well as the direction of movement of lifter 58. A field piece 80 of soft iron or similar material connects with the one end of core 78 and extends around coil 66 to complete a magnetic circuit through an armature 82.

An armature return spring 84 connects the field piece 80 with the armature 82 and biases armature 82 away from the core 78. Note that the armature return spring 84 is not riveted or soldered to the field piece 80 or armature 82. Rather, it is attached thereto by means of cooperating locking tabs as at 86 and 88 of spring 84.

The armature 82 includes a forward end 92 opposite a pivot axis 90, the forward end 92 being engaged in a notch 94 in lifter 58. In this manner, the lifter 58 is responsive to movement of armature 82. As current passes through coil 56, the armature 82 moves in a counterclockwise direction as illustrated in FIG. 1, thereby translating lifter 58 to the right. This causes clockwise movement of the separate blades 40. In the embodiment shown, this provides a four-pole, double-throw action.

Note that it is possible to easily replace the coil assembly by removing the leads 70 and 72 and merely lifting out the coil assembly. Again, no soldering or riveting or other manufacturing techniques are required for the assembly of the relay. Nonetheless, everything is retained in a compact, tight relationship by cooperation of cover 16 and housing 10.

Thus, while in the foregoing, there has been set forth a preferred embodiment of the present invention, it is to be understood that the subject matter of the invention is to be limited only by the following claims and their equivalents.

What is claimed is:

1. An improved miniature relay construction comprising, in combination:

a housing with a base, said base including a plurality of contact pins encapsulated therein and projecting in opposite directions to the exterior and to the interior of the housing;

a coil assembly mounted in the housing, said assembly including a coil with a longitudinal axis, a fixed core in the coil, a field piece having an armature attached thereto by an attached armature spring, said armature pivoted at one end to the field piece and biased by said spring away from said core;

a movable lifter in the housing generally adjacent to and parallel to the axis of the coil and translatable freely in said parallel direction, said lifter retained against substantial movement in other directions, the opposite end of said armature being drivingly connected to the lifter to translate the lifter in response to pivotal movement of the armature with respect to the field piece;

a plurality of moving blades, each blade being pivotally mounted on a separate pin for rotation in either direction and having a contact affixed to at least one end thereof, each end being cooperative with another separate associated contact pin; and means connecting said lifter and said moving blades to effect pivotal movement in both directions of each of the blades on the pin on which each is mounted, said lifter being translated in response to pivotal movement of the armature, said armature being pivoted away from the core by the spring and toward said core when sufficient current is passed through the coil.

2. The improved relay of claim 1 including a cover for retaining said blades, coil assembly and lifter within said housing.

3. The improved relay of claim 1 wherein said moving blades include at least two contact members attached to said blades on opposite sides of said pivot axis thereof.

4. The improved relay of claim 1 wherein said housing includes wall means separating said blades and wherein said lifter cooperates with said wall means to maintain said lifter in a position for movement parallel to the axis of said coil.

5. The improved relay of claim 1 wherein said means connecting said movable blades and said lifter comprise an extension for said blades cooperatively engaging an associated notch in said lifter.

6. The improved relay of claim 1 including a cover, said cover including cooperative means for maintaining said moving blades in a pivotal position within said housing.

7. The improved relay of claim 1 wherein each moving blade includes means for maintaining electric contact with the pivot pin on which each is mounted throughout the range of pivitol motion of said moving blade.

8. The improved relay of claim 1 wherein said armature return spring maintains said armature, said lifter and said moving blades in a first contact position and wherein said coil is operative to translate said armature, said lifter and said moving blades to a second contact position.

9. The improved relay of claim 1 including lead wires for said coil connected to separate contact pins projecting through said housing.

10. The improved relay of claim 1 wherein said contact pins comprise a pin member having oppositely projecting end portions interconnected by an intermediate section, said intermediate section being molded in position within said housing to maintain required orientation of said pins for relay action.

11. The improved relay of claim 1 wherein said armature return spring includes locking tabs and said armature includes openings for receipt of said locking tabs whereby the armature is maintained in biased position by said spring attached by the locking tabs.

* * * * *